United States Patent [19]

Piligrino

[11] 4,117,593

[45] Oct. 3, 1978

[54] KNIFE

[76] Inventor: Dimi Piligrino, 2152 Maha Pl., Honolulu, Hi. 96819

[21] Appl. No.: 797,836

[22] Filed: May 17, 1977

[51] Int. Cl.[2] ..... B26B 3/03; B26B 9/02

[52] U.S. Cl. ..... 30/314; D7/151; 30/315; 30/343; 30/356

[58] Field of Search ..... 30/123.7, 309, 314, 30/315, 316, 317, 353, 356, 346, 340, 342, 343, 164.9; 241/168; D7/151; D8/98; 7/1 A, 1 B

[56] References Cited

U.S. PATENT DOCUMENTS

| | | | |
|---|---|---|---|
| 80,765 | 8/1868 | Quackenbush | 30/315 X |
| D. 214,121 | 5/1969 | Cheslak | D8/98 |
| 310,606 | 1/1885 | Nagel | 30/353 |
| 457,385 | 7/1891 | Terrell | 30/315 |
| 587,873 | 8/1897 | Sisson | 30/346 X |
| 893,588 | 7/1908 | Hughes | 30/314 |
| 2,624,938 | 1/1953 | Davis | 30/315 X |
| 3,122,774 | 3/1964 | Lamb | 30/340 X |

FOREIGN PATENT DOCUMENTS

| | | | |
|---|---|---|---|
| 428,123 | 8/1911 | France | 30/315 |
| 398,116 | 9/1933 | United Kingdom | 30/309 |

*Primary Examiner*—N. P. Godici
*Attorney, Agent, or Firm*—James C. Wray

[57] ABSTRACT

A knife has a generally flat blade with a sharp curved lower cutting edge which terminates forwardly and rearwardly in sharp cutting ends; an upper surface of the blade opposite the cutting edge is extended upwardly and forms a stem, and a curved cross section outwardly pointed handle is connected to the stem so that maximum cutting force occurs on portions of the cutting edge nearest the rearward end of the blade. A food chopper is constructed with an upward and forward curving handle and a distal forward pointed end and a rearward proximal curved sharp end on the blade and with decreasing radii of curvature toward the rearward proximal end. A cutting knife is formed with a cutting edge of uniform radius of curvature terminating forwardly and rearwardly in distal and proximal pointed ends, with a central portion of an upper surface of the blade curving upward and rearwardly and integrally forming a stem. A rounded handle with a pointed end extends rearward from the stem in a direction generally parallel to a tangential direction of a center portion of the cutting edge.

12 Claims, 9 Drawing Figures

FIG. 1
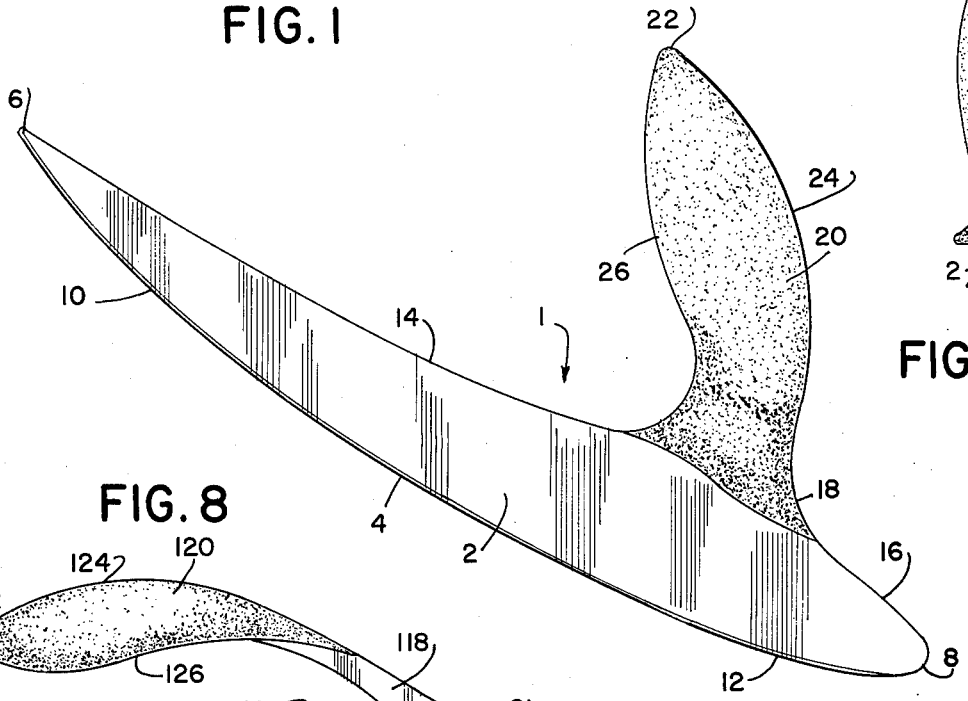
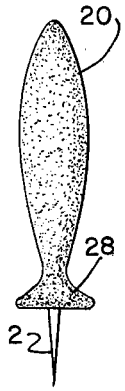
FIG. 1A
FIG. 8
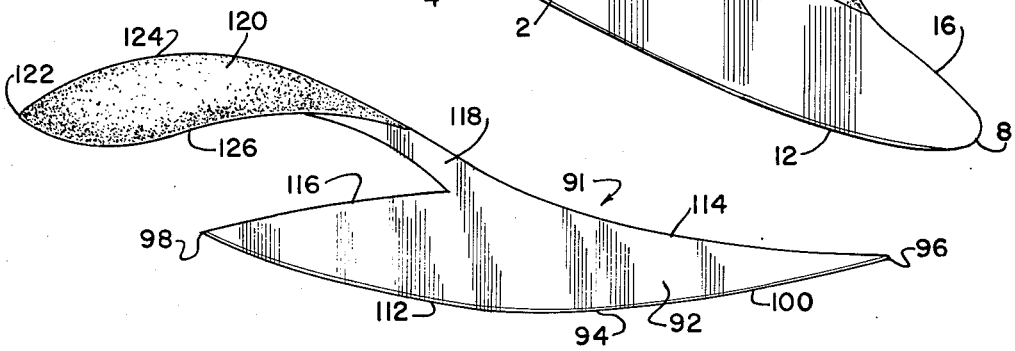
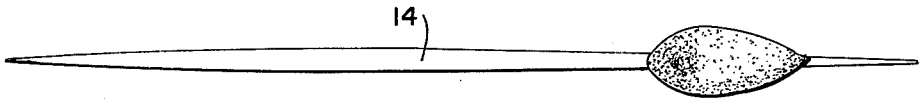
FIG. 3
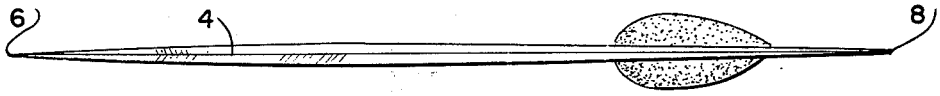
FIG. 2

FIG. 4
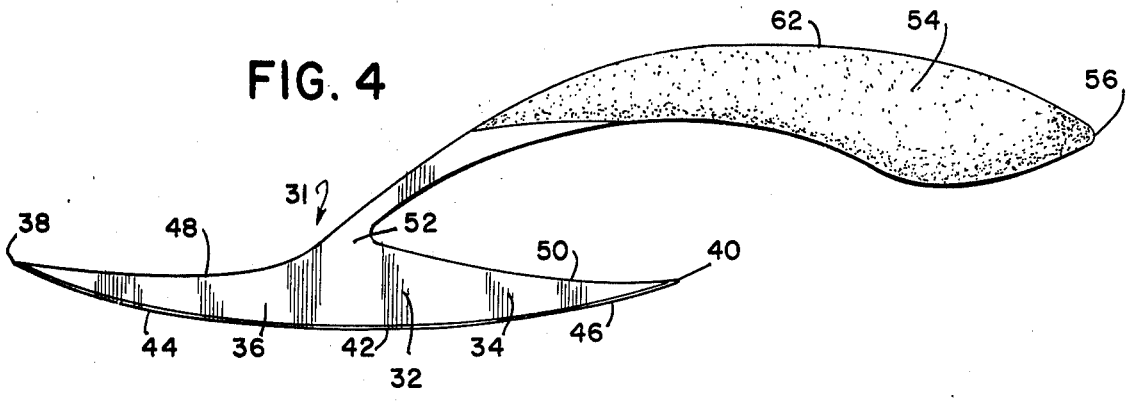
FIG. 5
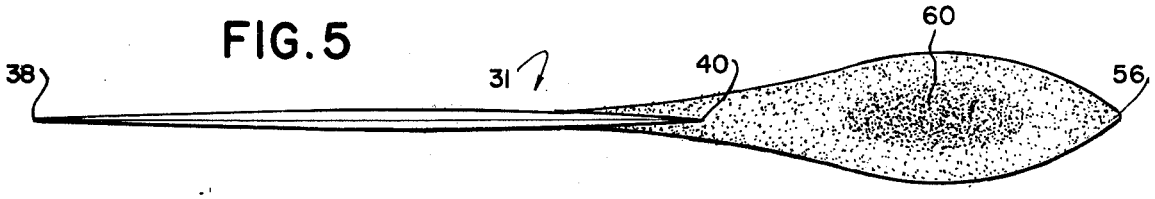
FIG. 6
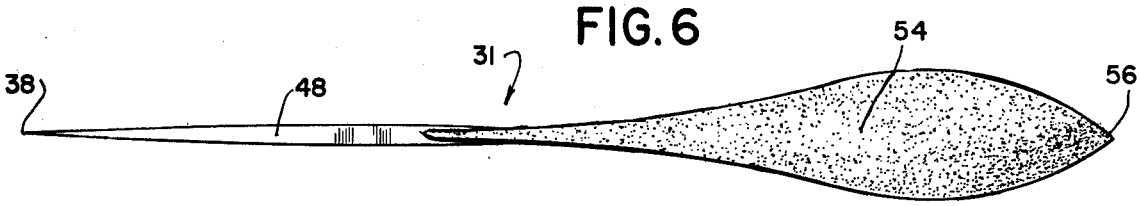
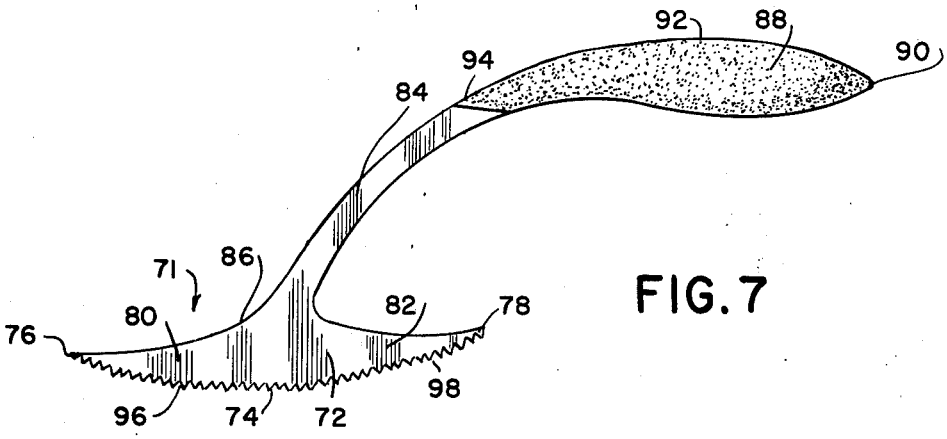
FIG. 7

KNIFE

BACKGROUND OF THE INVENTION

A collection of related knives is found in United States patents and foreign patents and publications collected by examiners in Class 30, subclasses 165, 272, 276, 309, 312, 314, 315, 346, 342 and 356; and in Design class 7, subclasses 142, 150, 151 and 106.

Examples of pertinent patents are as follows:

U.S. Pat. No. 424,954 has a curved blade on a table knife with a silverware handle.

U.S. Pat. No. 80,765 discloses a harness knife rounded blade with pointed ends and central rounded handle.

In U.S. Pat. No. 513,077 the handle extends upward from the blade middle.

U.S. Pat. No. 2,743,519 is directed to a fruit cutter with a rounded cutting edge and pointed ends.

U.S. Pat. No. 587,873 is a scraper of general interest.

U.S. Pat. No. 1,249,752 has a blade shape an handle position of interest.

U.S. Pat. No. 181,918 shows chopping knives with a rounded blade of interest.

U.S. Pat. No. 188,976 shows a rounded blade with central rounded handle.

U.S. Pat. No. 457,385 shows a tobacco knife rounded blade and a central rounded handle.

U.S. Pat. No. Des. 33,031 discloses a tang on the blade of this patent. The handle is not football-shaped.

SUMMARY OF THE INVENTION

The proposed devices are shown in three forms, a food chopper, a steak knife, a utility knife. All are similar but the handle and blade are of different proportions, shapes and relations. The handles are similar to a football, although not uniformly circular in cross-section.

The new blades and handles place the force on the cutting part of the knife and make chopping as well as slicing easier.

The sharp edge is along the bottom curved edge, but the sharp edge may continue at least a short way rearward from the point along the top for piercing and may continue around the curved rearward edge such as for puncturing when tenderizing meat.

Less effort is required for cutting with the present knives; weight of hand and arm provides pressure and pressure is applied directly on item to be cut.

The angle and position of the handle gives a more comfortable hold on the knife — wrist and hand are held at a more natural and comfortable position.

The shape of the handle is similar to a football although not as uniformly circular throughout the length of the handle. The handle comes to a point at the top and tapers at the bottom.

The angle of the handle permits the front point to be used for puncturing — tenderizing, etc.

The continuous curve of the blade gives the knife two curved cutting edges: forward and rearward of the center of the blade rather than the one curved cutting edge located near the distal point of an ordinary knife.

The continuously curving blade gives the blade a natural tendency to bite deeper with each stroke, forward and rearward.

The cutting force is placed directly above object to be cut. Two cutting edges make a continuously curving blade. The curving handles make a much more comfortable hold. With all three knives, the technical advantages are important. However, the comfort factors are equally important. The position, angle and shape of the handles makes the use of the three knives much more comfortable than conventional knives.

One object of the invention is the provision of a knife with a blade having a curved cutting edge terminating forwardly and rearwardly respectively in a forward sharp end and a rearward sharp end, the blade having an upper surface opposite the cutting edges between the forward and rearward ends, and a stem extending upwardly from an upper surface of the blade at a position between the forward and the rearward ends, a handle connected to the stem, and extending outward therefrom away from the blade, the handle being curved.

Another object of the invention is the provision of a knife with a handle curved oppositely a curve of a cutting edge of the blade.

A further object of the invention is the provision of a knife with a stem connected to an upper surface of the blade closer to a rearward edge than to forward edge and wherein the handle is curved upward and forwardly.

Another object of the invention is the provision of a knife with a handle having a round cross section which uniformly tapers to a pointed end remote from the blade.

A further object of the invention is the provision of a knife with a forward end of a blade as a sharp point and with a rearward end of the blade as a thin sharpened rounded end.

This invention has as another object the provision of a knife with a stem mounted on an upper surface of a blade opposite a curved cutting edge and near a rounded cutting end and with a handle curved upward and forward from the stem, wherein radii of curvature of the elongated cutting edge decrease uniformly approaching the rearward rounded cutting end whereby cutting pressure is increased by the changing radii and the handle location near the rounded end.

A further object of this invention is the provision of a knife with a curved cutting edge having a uniform radius of curvature and with forward and rearward ends of the blade terminating in pointed ends, wherein the blade is enlarged and extended upward in a central portion of an upper surface and wherein a stem integrally joins the upward extended portion of the upper surface and extends upward and rearward therefrom in a curvilinear arrangement.

Another object of the invention is the provision of a knife with a handle which curves upward and rearward from a central portion of a blade and which extends rearward beyond a rearward end of the blade.

A further object of the invention is the provision of a knife wherein a handle extends rearward beyond a pointed end of the blade in a direction generally parallel to a tangent to a central portion of a curved cutting edge of the blade.

A further object of the invention is the provision of a knife having a curving handle with a curve at a distal end extending in a generally downward direction and with a stem for mounting the handle extending from an upper center of a blade of the knife, whereby the knife provides the handle in such a way that enables the hand and wrist to be held in a natural and comfortable position while using the knife.

These and further and other objects and features of the invention are apparent in the disclosure which includes the above and ongoing description, the claims and the drawings.

BRIEF DESCRIPTION OF THE DRAWINGS

FIG. 1 is a side elevation of a cutting knife of the present invention.

FIG. 1A is a front elevation of the knife shown in FIG. 1.

FIG. 2 is a bottom view of the knife and FIG. 3 is a top view of the knife shown in FIG. 1.

FIG. 4 is a side elevation of a utility knife of the present invention.

FIG. 5 is a bottom view, and FIG. 6 is a top view of the knife shown in FIG. 4.

FIG. 7 is a steak knife embodiment of the knife of the present invention.

FIG. 8 is a side elevation of a knife according to the present invention.

DETAILED DESCRIPTION OF THE DRAWINGS

Referring to FIG. 1, the knife of the present invention is generally referred to by the numeral 1. A long blade 2 has a curved lower cutting edge 4 with a pointed forward end 6 and a sharpened curved rearward end 8. A forward curved cutting portion 10 of the sharp edge 4 extends from a medial point of the blade to the forward end 6. A rearward curved portion 12 of the lower cutting edge 4 extends from a medial portion of the blade to the curved rearward cutting end 8. Radii of curvature uniformly decrease from the cutting portion 10 to the rearward routed cutting edge 8. An upper surface 14 is rounded or flat, and a rearward section 16 of the upper surface is similarly formed. A stem portion 18 extends upward from the upper surface, and a handle 20 is connected to the stem portion. Handle 20 is shaped with a generally round cross section and a pointed distal end 22, and the handle curves upward and forward from the stem 18.

In use, handle 20 is gripped with the hand extending outward from the wrist and the heel of the hand resting upon the rearward curve 24 of the handle and the fingers surrounding the forward side 26 of the handle.

An enlarged portion 28 of the bottom of handle 20 provides a hand rest and keeps a hand from slipping toward the blade 2.

Chopping may be done with a portion of edge 4 directly beneath the handle. Chopping of light food may be accomplished by rocking the knife back and forth on its sharpened lower edge. The knife shown in FIGS. 1, 2 and 3 is also useful for slicing while drawing the knife back and forth with the curved portion of the cutting edge first slicing into the material on the forward thrust and the curved rearward portion 12 first slicing into the material on the rearward thrust.

The knife may be used by inverting the knife and holding the knife with the thumb close to the stem 18, while using the point 6 as a prick to lance materials.

During ordinary use of the knife, the angle of the handle and the position of the handle gives a more comfortable hold on the knife with the wrist and hand held in a comfortable and strong and accuracy promoting aligned direction. The weight of the hand and arm falls naturally upon the sharp edge 4 and consequently no downward torquing of the sharp edge is required, enabling long usage of the knife without cramping of arms and hands.

An embodiment of the knife present invention is shown in FIG. 4 and FIGS. 5 and 6 and is generally referred to by the numeral 31. A blade 32 has a thick rearward portion 34 and a thin forward portion 36 which terminate respectively in forward points 38 and rearward point 40. The lower cutting edge 42 is formed with generally a single radius of curvature. A forward portion 44 of the cutting edge is curved similar to a rearward portion 46 of the cutting edge. The upper surface 48 of the utility knife is rounded but alternatively, the upper surface may be flattened. A rearward portion 50 of the upper surface slopes upwardly with a more pronounced angle than a forward portion of the upper surface 48. Centrally, the upper surface has integrally formed thereon a stem 52 which extends upward and rearward in a curving relationship to the blade. A handle 54 which has a generally round cross section and a rounded conical end 56 lies on an axis which is generally parallel to a tangent of the cutting edge 42 at its center. The bulbous portion 58 of the utility knife 31 receives the palm of the hand and the fingers of the hand are wrapped around a throat portion 60 of the handle with the thumb resting on an upper curvature 62 or wrapped around the handle.

As shown, the upper curvature of the handle 62 is similar to the curvature 42 of the cutting edge of the blade which promotes a feel in using the knife.

A modification of the knife shown in FIG. 7 is intended primarily as a steak knife or meat cutting knife, generally indicated by the numeral 71. Blade 72 has a lower serrated cutting edge 74 which has a general radius of curvature which is uniform from the forward end 76 to the rearward end 78. Both ends are pointed, and the forward portion 80 of the blade is similar in configuration to a rearward portion 82. Stem 84 integrally extends upward from a rounded upper surface of the blade. Handle 88 extends rearward and is rounded about an axis which is generally parallel to a tangent of a central portion of the radius of curvature of cutting edge 74. The rearward end 90 of the handle is in the form of a rounded cone, and the upper edge 92 of the handle forms a uniform curve with the upper edge 94 of the stem, which radius of curvature is approximately equal to a radius of curvature of the cutting edge 74.

Handle 88 is displaced a substantial distance from the cutting edge 74.

The forward rounded serrated portion 96 of the cutting edge 74 first cuts into meat upon the forward movement of the blade and the rearward rounded portion 98 of the serrated cutting edge 74 cuts into the meat upon rearward movement of the knife.

FIG. 8 shows a side elevation of a utility knife 91. Blade 92 has a lower cutting edge 94 with a pointed forward end 96 and a pointed rearward end 98. A rounded forward cutting portion 100 of edge 94 smoothly joins rearward edge portion 112. Front upper surface 114 blends smoothly in to curving stem 118. Rearward upper edge 116 is relatively lowered. Handle tapers rearwardly to rounded conical end 122. Upper rounded surface 124 fits the palm of a hand, while bulbous lower surface 126 provides a solid finger grip.

As shown in FIGS. 8 and 4 and 7, the preferred embodiment of the knife has a stem which raises from a center of a blade and extends upward and continues in a handle which curves rearward and then downward to provide a comfortable position for the hand and wrist while using the knife.

While the invention has been described with reference to specific embodiments, it will be obvious that several modifications of the invention may be constructed without departing from the scope of the invention, which is precisely defined only in the following claims.

I claim:

1. A knife comprising a blade having a convex curved lower elongated cutting edge terminating forwardly and rearwardly respectively in a forward sharp end and a rearward sharp end and having at least one of the ends pointed, the blade having an upper surface opposite the cutting edges between the forward and rearward ends, and a continuously uniformly curving stem extending upwardly from an upper surface of the blade at a position from the forward to the rearward ends, a handle connected to the stem, and continuously uniformly curving with the stem and extending outward therefrom away from the blade and wherein the handle has an elongated upper convex curve opposite to the convex curve of the cutting edge of the blade in a plane of the blade.

2. The knife of claim 1 wherein the stem is connected to an upper surface of the blade closer to a rearward edge than to a forward edge and wherein the handle is curved upward and forwardly.

3. The knife of claim 1 wherein the handle has a rounded cross section which uniformly tapers to a small end remote from the blade.

4. The knife of claim 1 wherein a forward end of the blade is a sharp point and wherein a rearward end of the blade is a thin sharpened rounded end.

5. The knife of claim 4 wherein the stem is mounted on an upper surface of the blade opposite the curved cutting edge and near the rounded cutting end and wherein the handle is curved upward and forward from the stem and wherein radii of curvature of the elongated cutting edge decrease uniformly approaching the rearward rounded cutting end whereby cutting pressure is increased by the changing radii and handle location near the rounded end.

6. The knife of claim 1 wherein the curved cutting edge has a uniform radius of curvature and wherein forward and rearward ends of the blade terminate in pointed ends wherein the blade is enlarged and extended upward in a central portion of an upper surface thereof and wherein the stem integrally joins the upward extended portion of the blade and extends upward and rearward therefrom in a curvilinear arrangement.

7. The knife of claim 6 wherein the handle extends rearward beyond a rearward end of the blade.

8. The knife of claim 7 wherein the handle extends rearward beyond a pointed end of the blade in a direction generally parallel to a tangent to a central portion of the curved cutting edge of the blade.

9. The knife of claim 1 wherein the stem is connected to a medial portion of the upper edge of the blade spaced from forward and rearward ends thereof.

10. The knife of claim 1 wherein the handle curves upward and rearward and downward away from the blade.

11. The knife of claim 10 wherein the handle is bulbous and has a relatively thick central portion and relatively thin forward and rearward portions.

12. The knife of claim 11 wherein the relatively thick portion has an upper surface which slopes rearward and downward.

* * * * *